US011852352B2

(12) United States Patent
Felices Betran et al.

(10) Patent No.: US 11,852,352 B2
(45) Date of Patent: Dec. 26, 2023

(54) DOMESTIC APPLIANCE DEVICE

(71) Applicant: BSH Hausgeräte GmbH, Munich (DE)

(72) Inventors: Jorge Felices Betran, Huesca (ES); Juan Jose Galindo Perez, Saragossa (ES); Pablo Jesus Hernandez Blasco, Saragossa (ES); Izaskun Jaca Equiza, Saragossa (ES); Ignacio Lope Moratilla, Saragossa (ES); Damaso Martin Gomez, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 552 days.

(21) Appl. No.: 17/053,372

(22) PCT Filed: May 24, 2019

(86) PCT No.: PCT/IB2019/054316
§ 371 (c)(1),
(2) Date: Nov. 6, 2020

(87) PCT Pub. No.: WO2019/243920
PCT Pub. Date: Dec. 26, 2019

(65) Prior Publication Data

US 2021/0190327 A1 Jun. 24, 2021

(30) Foreign Application Priority Data

Jun. 21, 2018 (ES) ..... 201830619

(51) Int. Cl.
*H05B 6/12* (2006.01)
*H05B 6/06* (2006.01)
(Continued)

(52) U.S. Cl.
CPC ..... *F24C 15/34* (2013.01); *H05B 6/129* (2013.01); *F24C 15/021* (2013.01); *H05B 2206/044* (2013.01)

(58) Field of Classification Search
CPC .. F24C 15/021; F24C 15/34; H05B 2206/044; H05B 6/129; F02M 2200/8015;
(Continued)

(56) References Cited

U.S. PATENT DOCUMENTS

| | | | | |
|---|---|---|---|---|
| 10,764,970 | B2 | 9/2020 | Giordano | |
| 11,438,975 | B2 * | 9/2022 | Acero Acero | H05B 6/362 |
| 2011/0132900 | A1 * | 6/2011 | Kinoshita | F24C 15/101 219/443.1 |

FOREIGN PATENT DOCUMENTS

| | | | |
|---|---|---|---|
| CN | 103549231 | A | 2/2014 |
| DE | 2102015 | A1 | 7/1972 |

(Continued)

OTHER PUBLICATIONS

National Search Report ES 201830619 dated Mar. 29, 2019.
International Search Report PCT/IB2019/054316 dated Aug. 5, 2019.

*Primary Examiner* — Quang T Van
(74) *Attorney, Agent, or Firm* — Michael E. Tschupp; Andre Pallapies; Brandon G. Braun

(57) ABSTRACT

A household appliance device includes a first structural unit, a second structural unit, and an insulation unit configured to provide an insulation between the first and second structural units. The insulation unit includes a placement assist element configured to tailor an exterior shape of the insulation unit to the first structural unit for placement of the insulation unit, and an expansion compensation element configured to compensate at least substantially a thermal expansion of at least one subregion of the insulation unit.

28 Claims, 8 Drawing Sheets

(51) Int. Cl.
*F24C 15/34* (2006.01)
*F24C 15/02* (2006.01)

(58) Field of Classification Search
CPC ..... F02M 2200/803; F02M 2200/852; F02M 55/02; F02M 61/14; F02M 61/16; F02M 61/168
USPC ..... 219/620, 622, 624, 629, 632, 601, 670, 219/671, 675, 679, 680, 738, 741, 756
See application file for complete search history.

(56) References Cited

FOREIGN PATENT DOCUMENTS

| | | | |
|---|---|---|---|
| DE | 8513460 | U1 | 6/1985 |
| DE | 19822034 | A1 | 11/1999 |
| EP | 2275746 | A2 | 1/2011 |

* cited by examiner

DOMESTIC APPLIANCE DEVICE

CROSS-REFERENCES TO RELATED APPLICATIONS

This application is the U.S. National Stage of International Application No. PCT/IB2019/054316, filed May 24, 2019, which designated the United States and has been published as International Publication No. WO 2019/243920 A1 and which claims the priority of Spanish Patent Application, Serial No. P201830619, filed Jun. 21, 2018, pursuant to 35 U.S.C. 119(a)-(d).

BACKGROUND OF THE INVENTION

The invention relates to a household appliance device.

A household appliance device configured as an oven device with an insulation unit is already known from the prior art. The insulation unit is provided for electrical insulation between a first structural unit, which is configured as an oven muffle, and a second structural unit, which is configured as an induction heating cable of the oven. In a mounted state the insulation unit is largely arranged between the first structural unit and the second structural unit. In a mounted state the insulation unit is arranged flat on a wall of the first structural unit. When the insulation unit is subject to thermal heating, for example due to a cooking operation taking place in the muffle, there is a risk that the insulation unit will undergo deformation, which could adversely affect the optimal arrangement of the induction heating cable arranged above the insulation unit relative to the muffle.

BRIEF SUMMARY OF THE INVENTION

It is the object of the invention in particular to provide a generic device with an advantageous construction.

A household appliance device, in particular a household cooking appliance device, advantageously an oven device and preferably an induction oven device, is proposed, with at least one insulation unit, which is provided for in particular electrical and/or thermal insulation between at least one first structural unit and at least one second structural unit and which has at least one placement assist element, which is provided to tailor an exterior shape and/or form of the insulation unit to the first structural unit for the purpose of placing the insulation unit, and at least one expansion compensation element, which is provided to compensate at least substantially for thermal expansion of at least one subregion of the insulation unit.

Such a configuration results in an advantageous construction. In particular the expansion compensation element can in particular specifically prevent deformation of the insulation unit, ensuring an optimal arrangement of the second structural unit relative to the first structural unit and/or optimal heating of items to be cooked within the first structural unit even at high temperatures. The placement assist element allows the insulation unit to be arranged in particular flexibly and/or on any subregion of the first structural unit, in particular irrespective of the form of the structural unit in the subregion. In particular optimal, in particular electrical and/or thermal, insulation is possible between the first structural unit and the second structural unit, allowing a durable configuration to be achieved.

A "household appliance device", in particular a "cooking appliance device", advantageously an "oven device" and particularly advantageously an "induction oven device" refers in particular to at least one part, in particular a subassembly, of a household appliance, in particular of a cooking appliance, advantageously of an oven and particularly advantageously of an induction oven. For example a household appliance having the household appliance device could be a chest freezer and advantageously a refrigerator and/or freezer cabinet. Alternatively or additionally a household appliance having the household appliance device could be in particular a cleaning appliance, for example a dishwasher and/or a washing machine and/or a tumble dryer. A household appliance having the household appliance device is advantageously a cooking appliance. A household appliance configured as a cooking appliance could be for example a cooktop, preferably an induction cooktop, and/or a microwave and/or a grill appliance and/or a steam cooking appliance. A household appliance configured as a cooking appliance is advantageously an oven and preferably an induction oven.

For example the second structural unit could be larger than the first structural unit. The first structural unit is advantageously larger than the second structural unit. The expression that an object is "larger" than another object means in particular that the object has a mass and/or volume that is at least 110%, in particular at least 120%, advantageously at least 150%, particularly advantageously at least 175%, preferably at least 200% and particularly preferably at least 250% of the mass and/or volume of the other object.

For example the first structural unit could be arranged above the second structural unit in an installed position. In an installed position the second structural unit is arranged in particular above the first structural unit.

The household appliance device in particular has the first structural unit. The first structural unit could be for example a receiving plate and/or a cooktop plate, which could be provided in particular to receive cooking utensils. The first structural unit is advantageously a muffle, which in particular at least partially defines and/or delimits a cooking space, which is provided in particular for the introduction of items to be cooked, in particular for the purpose of heating and/or cooking. The expression that the muffle "at least partially" defines and/or delimits a cooking space means in particular that the muffle defines and/or delimits the cooking space alone and/or together with at least one further unit, for example with at least one door.

The household appliance device in particular has the second structural unit. The second structural unit could be for example an electronics unit and/or a control unit and/or an operator interface. The second structural unit is advantageously at least one heating unit. A "heating unit" in this context refers in particular to a unit which is provided to supply energy to at least one object to be heated for the purpose of heating the object to be heated in at least one operating state. For example the heating unit could be configured as a resistance heating unit, provided in particular to convert energy to heat and supply said heat to the object to be heated for the purpose of heating the object to be heated. Alternatively or additionally the heating unit could be configured as an induction heating unit, provided in particular to supply energy in the form of an electromagnetic alternating field to the object to be heated, it being possible for the energy supplied to the object to be heated to be converted to heat in particular in the object to be heated. The object to be heated could be for example a cooking utensil and/or at least one wall, in particular at least one muffle wall.

In particular the insulation unit is arranged at least largely between the first structural unit and the second structural unit in at least one mounted state. When viewing a main extension plane of the insulation unit in a perpendicular manner the insulation unit extends in particular over a portion of at least 20%, in particular at least 40%, advantageously at least 60%, particularly advantageously at least 70% and preferably at least 80% of a surface, in particular a wall, of the first structural unit, on which the insulation unit in particular is arranged. In particular in an installed position when a main extension plane of the insulation unit is viewed in a perpendicular manner a surface extension of the insulation unit is greater than a surface extension of the second structural unit.

A "main extension plane" of an object refers in particular to a plane, which is parallel to a largest side surface of a smallest imaginary geometric cuboid that still encloses the object completely and runs in particular through the center point of the cuboid. "At least largely" means in particular by a portion, in particular a mass portion and/or volume portion, of at least 70%, in particular at least 80%, advantageously at least 90% and preferably at least 95%.

For example the insulation unit could have at least one main function, which could be in particular thermal insulation between the first structural unit and the second structural unit. The insulation unit in particular has at least one main function, which is in particular electrical insulation between the first structural unit and the second structural unit. In particular the insulation unit has at least one secondary function, which is in particular thermal insulation between the first structural unit and the second structural unit, in particular in addition to the main function of electrical insulation between the first structural unit and the second structural unit.

The expression that the insulation unit is provided for insulation "between" at least one first structural unit and at least one second structural unit means in particular that the insulation unit is provided to insulate the first structural unit from the second structural unit and/or to insulate the second structural unit from the first structural unit and/or both to insulate the first structural unit from the second structural unit and the second structural unit from the first structural unit.

In at least one operating state the insulation unit in particular reduces the passage of energy, in particular electrical energy and/or thermal energy, between the first structural unit and the second structural unit in particular measurably, in particular when compared with a configuration that avoids and/or lacks an insulation unit. In at least one operating state the insulation unit in particular takes the energy from the first structural unit and/or the second structural unit and absorbs said energy in particular at least largely and/or in particular prevents a transfer of the energy between the first structural unit and the second structural unit. In particular in at least one operating state the insulation unit reduces the probability of an in particular electrical short circuit between the first structural unit and the second structural unit in particular measurably, in particular when compared with a configuration that avoids and/or lacks an insulation unit. In particular in at least one operating state the insulation unit reduces the probability of a transfer of heat between first structural unit and the second structural unit in particular measurably, in particular when compared with a configuration that avoids and/or lacks an insulation unit.

In particular the placement assist element allows an exterior shape and/or form of the insulation unit to be changed and/or to be tailored to an exterior shape and/or form of the first structural unit. The insulation unit can in particular be kinked and/or bent by means of the placement assist element, in particular in a simple manner. In particular the placement assist element allows at least two subregions of the insulation unit, which can in particular be arranged adjacent to one another in at least one unmounted state, to be arranged one above the other and/or overlapping, in particular in at least one direction which is aligned in particular perpendicular to a main extension plane of at least one of the subregions.

An "unmounted" state, in particular of the insulation unit, refers in particular to a state in which the insulation unit is arranged in particular at least largely within one plane and/or in which the insulation unit is unrolled in particular in one plane. The unmounted state takes place in particular temporally before mounting the insulation unit and/or before arranging the insulation unit on the first structural unit. In the unmounted state, in particular when at least one subregion of the insulation unit is viewed in a perpendicular manner, the insulation unit has a maximum surface extension in a plane spanned by the subregion. In particular the insulation unit is free of kinks and/or undulations and/or bends in the unmounted state.

The expression that the expansion compensation element is provided to "compensate" at least substantially for thermal expansion of at least one subregion of the insulation unit means in particular that in at least one operating state the expansion compensation element at least substantially prevents and/or reduces a transfer of the thermal expansion of the subregion from the subregion to at least one further subregion of the insulation unit that in particular surrounds the subregion and/or adjoins the subregion, in particular when compared with a configuration that avoids and/or lacks the expansion compensation element. In particular in at least one operating state the expansion compensation element at least largely absorbs thermal expansion of the subregion of the insulation unit. In at least one operating state the expansion compensation element in particular reduces thermal expansion of the subregion of the insulation unit, in particular when compared with a configuration that avoids and/or lacks the expansion compensation element.

The expansion compensation element is arranged in particular in a region of the insulation unit, in which maximum thermal stresses occur in the insulation unit in a heating operating state. In particular a longitudinal extension direction of the expansion compensation element is aligned at least substantially perpendicular to a direction of the thermal stresses. The placement assist element is in particular in a region of the insulation unit, in which low thermal stresses occur in the insulation unit in a heating operating state.

A "longitudinal extension direction" of an object refers in particular to a direction aligned parallel to a longest side of a smallest imaginary geometric cuboid that still encloses the object completely. The expression "substantially perpendicular" here in particular defines an alignment of a direction relative to a reference direction, the direction and the reference direction being at an angle of 90°, in particular in one plane, and the angle having a maximum deviation of in particular maximum 8°, advantageously maximum 5° and particularly advantageously maximum 2°.

"Provided" means in particular specifically designed and/or equipped. That an object is provided for a specific function means in particular that the object performs and/or executes said specific function in at least one application and/or operating state.

It is further proposed that a longitudinal extension direction of at least one segment of the placement assist element is aligned at an angle to a longitudinal extension direction of at least one segment of the expansion compensation element in at least one unmounted state. In particular the segment of the placement assist element and the segment of the expansion compensation element are at least largely arranged in an in particular common plane, which is spanned in particular by the insulation unit, in at least one unmounted state. The placement assist element could have for example just one segment, which could at least largely and advantageously completely define in particular a shape and/or form of the placement assist element. Alternatively the placement assist element could have in particular at least two, in particular at least three, advantageously at least four, particularly advantageously at least five, preferably at least seven and particularly preferably multiple segments, which in particular together could at least largely and advantageously completely define a shape and/or form of the placement assist element. The expansion compensation element could have for example just one segment, which in particular could at least largely and advantageously completely define a shape and/or form of the expansion compensation element. Alternatively the expansion compensation element could have in particular at least two, in particular at least three, advantageously at least four, particularly advantageously at least five, preferably at least seven and particularly preferably multiple segments, which in particular together could at least largely and advantageously completely define a shape and/or form of the expansion compensation element. The expression that a direction is aligned "at an angle" to another direction means in particular that the direction is at a minimum angle of more than 0° and maximum 90° to the further direction, in particular in a plane within which the direction and the further direction are arranged and which is spanned in particular by the insulation unit. In particular the longitudinal extension direction of the segment of the placement assist element is at a minimum angle of at least 5°, in particular at least 10°, advantageously at least 15°, particularly advantageously at least 20°, preferably at least 30° and particularly preferably at least 40° to the longitudinal extension direction of the segment of the expansion compensation element in at least one unmounted state. In particular the longitudinal extension direction of the segment of the placement assist element is at a minimum angle of maximum 90°, in particular maximum 85°, advantageously maximum 80°, particularly advantageously maximum 70°, preferably maximum 60° and particularly preferably maximum 50° to the longitudinal extension direction of the segment of the expansion compensation element in at least one unmounted state. This allows the segment of the placement assist element and the segment of the expansion compensation element to be arranged in particular flexibly relative to one another, in particular in such a manner as to ensure optimum functionality of the placement assist element and the expansion compensation element. In particular it allows optimum placement of the insulation unit and/or optimum compensation for thermal expansion of the subregion of the insulation unit.

It is also proposed that the placement assist element has at least one notch in the insulation unit and in particular is formed by at least one notch in the insulation unit in at least one unmounted state. For example the placement assist element could have at least two, in particular at least three, advantageously at least four, particularly advantageously at least five, preferably at least seven and particularly preferably multiple notches, which could in particular transition into one another and which could in particular have different longitudinal extension directions from one another, which could in particular be aligned at an angle to one another. The placement assist element in particular has just one notch, which is configured in particular in a straight line. A "notch" refers in particular to a slit and/or an elongated recess, which could be produced and/or introduced into the insulation unit by means of at least one cutting process and/or by means of at least one process that is not a cutting process. This in particular allows economical and/or simple production. In particular an optimum and/or maximum effect can be achieved in a simple manner, allowing a high level of efficiency in particular to be achieved.

It is also proposed that in at least one unmounted state the placement assist element adjoins a lateral boundary of the insulation unit and in particular from the lateral boundary of the insulation unit, which the placement assist element adjoins in at least one unmounted state, faces in the direction of at least one further lateral boundary of the insulation unit and/or in the direction of an inner region of the insulation unit. A "lateral" boundary of the insulation unit in at least one unmounted state refers in particular to a boundary and/or an edge, which in the unmounted state delimits and/or defines and/or bounds a surface extension of the insulation unit, which the insulation unit spans in particular in the main extension plane when a main extension plane of the insulation unit is viewed in a perpendicular manner. This in particular allows optimum tailoring of an exterior shape of the insulation unit to the first structural unit and/or optimum placement of the insulation unit on the first structural unit. In particular the placement assist element can be produced in a simple and/or uncomplicated manner, as it is possible in particular to ensure easy accessibility when producing the placement assist element.

For example in at least one unmounted state the placement assist element could be aligned at an angle to the lateral boundary of the insulation unit and/or in particular be at a minimum angle of at least substantially 90° to the lateral boundary. In at least one unmounted state the placement assist element is preferably at a minimum angle of at least substantially 45° to the lateral boundary of the insulation unit. "At least substantially" in this context means in particular that a deviation deviates from a predefined value in particular by maximum 25%, preferably maximum 10% and particularly preferably maximum 5% of the predefined value. This in particular allows an exterior shape of the placement assist element to be tailored in particular particularly optimally to the first structural unit.

It is also proposed that in at least one unmounted state the expansion compensation element has at least one material weakening of the insulation unit and in particular is formed by at least one material weakening of the insulation unit. A "material weakening" of an object refers in particular to a subregion of the object, in which the object demonstrates at least a reduced material strength and/or thickness relative to at least one further subregion of the object and/or relative to remaining subregions of the object, which could in particular be greater than the subregion and which could in particular at least largely define and/or form the object. A "thickness" of an object refers in particular to a shortest extension of a smallest imaginary geometric cuboid that still encloses the object. The material weakening could be for example a recess and/or a hole and/or a slit and/or reduced material strength and/or a slot in the insulation unit. The material weakening is advantageously a notch in the insulation unit. This in particular compensates optimally for thermal expansion of at least one subregion of the insulation unit in a simple manner, preventing in particular any deformation of the insulation unit and/or movement of the second structural unit relative to the first structural unit.

In at least one unmounted state the expansion compensation element could for example adjoin a lateral boundary of the insulation unit when a main extension plane of the insulation unit is viewed in a perpendicular manner. In at least one unmounted state the expansion compensation element is preferably arranged completely within a surface extension of the insulation unit in the main extension plane when a main extension plane of the insulation unit is viewed in a perpendicular manner. This in particular allows a high level of stability to be achieved.

For example the household appliance device could have just one, in particular a single insulation unit, in particular the insulation unit. The household appliance device preferably has at least one further insulation unit, which has at least one further placement assist element, which is provided in particular to tailor an exterior shape of the further insulation unit to the first structural unit for the purpose of placing the further insulation unit, and at least one further expansion compensation element, which is provided in particular to compensate at least substantially for thermal expansion of at least one subregion of the further insulation unit and which differs from the insulation unit in at least one feature. This in particular allows an arrangement of at least two insulation units one above the other and/or overlapping, in particular in a direction aligned perpendicular to one of the insulation units, resulting in particular in optimized and/or maximum insulation between the first structural unit and the second structural unit.

In at least one unmounted state the insulation unit and the further insulation unit could for example differ from one another in the number of placement assist elements and/or in the number of expansion compensation elements. Alternatively or additionally in at least one unmounted state the insulation unit and the further insulation unit could for example differ in the arrangement of at least one placement assist element and/or at least one expansion compensation element relative to a lateral boundary of the insulation unit and/or relative to one another. Alternatively or additionally for example the insulation unit and the further insulation unit could differ in surface extension and/or exterior form. In at least one unmounted state the insulation unit and the further insulation unit preferably have at least substantially the same surface extension and advantageously at least substantially the same exterior form. The expression that in at least one unmounted state the insulation unit and the further insulation unit have "at least substantially" the same surface extension means in particular that in at least one unmounted state a quotient of a surface extension of the insulation unit and a surface extension of the further insulation unit has a value of at least 0.9, in particular at least 0.92, advantageously at least 0.94, particularly advantageously at least 0.96, preferably at least 0.98 and particularly preferably at least 0.99 and/or that in at least one unmounted state a quotient of a surface extension of the insulation unit and a surface extension of the further insulation unit has a value of maximum 1.1, in particular maximum 1.08, advantageously maximum 1.06, particularly advantageously maximum 1.04, preferably maximum 1.02 and particularly preferably maximum 1.01. This allows the insulation unit and the further insulation unit to be arranged one above the other and/or overlapping in particular in an optimum manner, in particular allowing an optimized and/or maximum insulation effect.

It is also proposed that in at least one unmounted state when a main extension plane of the insulation unit is viewed in a perpendicular manner and when there is an overlapping arrangement of the insulation unit and the further insulation unit, the placement assist element and the further placement assist element are arranged without overlap. In particular in at least one unmounted state when a main extension plane of the insulation unit is viewed in a perpendicular manner and the overlapping arrangement is present, at least one lateral boundary of the insulation unit and at least one lateral boundary of the further insulation unit, in particular lateral boundaries of the insulation unit and lateral boundaries of the further insulation unit, are located one on top of one another and/or above one another. This prevents direct and/or electrically conducting contact between the first structural unit and the second structural unit in particular in a simple and/or uncomplicated manner, allowing in particular a high level of functionality and/or a high level of viability to be achieved.

It is further proposed that in at least one unmounted state when a main extension plane of the insulation unit is viewed in a perpendicular manner and when there is an overlapping arrangement of the insulation unit and the further insulation unit, the expansion compensation element and the further expansion compensation element are arranged without overlap. This in particular prevents, in particular electrically conducting, contact between the first structural unit and the second structural unit and/or the occurrence of electrical short circuits, allowing in particular a high level of operator convenience and/or a durable configuration and/or a high level of viability to be achieved.

The insulation unit could be configured asymmetrically for example, for example in respect of a center point and/or center of gravity of the insulation unit. In particular in the case of an asymmetrical insulation unit the household appliance device could in particular have at least one second insulation unit, which could be configured identically to the insulation unit. In particular in at least one unmounted state and when there is an overlapping arrangement of the insulation unit and the second insulation unit, the insulation unit and the further insulation unit could be twisted relative to one another, for example by rotating the second insulation unit, in particular about a rotation axis, which is aligned perpendicular to the second insulation unit and runs through a center point and/or center of gravity of the second insulation unit, through an angle of at least substantially 90° and/or at least substantially 180°. In at least one unmounted state and when there is an overlapping arrangement of the insulation unit and the second insulation unit, the placement assist element of the insulation unit and a second placement assist element of the second insulation unit could in particular be arranged without overlap. In at least one unmounted state and when there is an overlapping arrangement of the insulation unit and the second insulation unit, the expansion compensation element of the insulation unit and a second expansion compensation element of the second insulation unit could in particular be arranged without overlap. This in particular reduces storage outlay and/or the number of parts required.

The insulation unit and/or the further insulation unit are preferably configured symmetrically, allowing simple mounting in particular.

For example the insulation unit could be configured as a single piece and the further insulation unit could have at least one further first insulation subelement and at least one further second insulation subelement, which could be provided in particular for modular mounting. Alternatively for example the further insulation unit could be configured as a single piece and the insulation unit could have at least one first insulation subelement and at least one second insulation subelement, which could be provided in particular for modular mounting. The insulation unit is preferably configured as a single piece and in particular the further insulation unit is configured as a single piece, in particular in addition to the first insulation unit. "As a single piece" means in particular at least connected with a material fit, for example by means of a welding process, an adhesion process, an injection process and/or another process that appears expedient to the person skilled in the art, and/or advantageously formed in one piece, for example being produced from one casting and/or being produced using a single or multiple component injection method advantageously from a single blank. This in particular allows stable construction and/or simple production of the insulation unit and/or the further insulation unit to be achieved. This in particular reduces storage outlay and/or the number of parts required.

It is also proposed that the insulation unit and in particular the further insulation unit has at least one first insulation subelement and at least one second insulation subelement, which are provided for modular mounting. In particular the further insulation unit has at least one further first insulation subelement and at least one further second insulation subelement, which are provided in particular for modular mounting. The expression that a first object and a second object are provided for "modular" mounting means in particular that the first object and the second object are provided for mounting following the principle of building sets and/or building blocks and are configured in particular so that the first object and the second object can be put together and/or can interact by way of corresponding interfaces in particular based on a suitable form and/or based on a suitable functionality. This in particular allows a particularly flexible configuration to be achieved.

For example the first insulation subelement and the second insulation subelement could be configured at least substantially and in particular completely identically. The further first insulation subelement and the further second insulation subelement could for example be configured at least substantially and in particular completely identically. In particular the first insulation subelement and the second insulation subelement could differ in at least one feature from the further first insulation subelement and the further second insulation subelement. The first insulation subelement and the second insulation subelement preferably differ from one another in at least one feature, in particular size and/or form. The further first insulation subelement and the further second insulation subelement differ from one another in particular in at least one feature, in particular size and/or form. The feature, in which the insulation subelements in particular differ from one another, could be for example size and/or form. Alternatively or additionally the feature, in which the insulation subelements in particular differ from one another, could be for example an arrangement of at least one placement assist element of in particular any insulation unit relative to a lateral boundary and/or relative to at least one expansion compensation element of the insulation unit. The feature, in which the insulation subelements in particular differ from one another, could alternatively or additionally be for example the arrangement of at least one expansion compensation element of in particular any insulation unit relative to a lateral boundary and/or relative to at least one placement assist element of the insulation unit. This allows in particular an extremely high level of flexibility and/or prevents in particular direct electrical contact between the first structural unit and the second structural unit, in particular when there is an overlapping arrangement of the insulation unit and the further insulation unit.

It is also proposed that the insulation unit and/or the further insulation unit is/are made at least largely of mica, in particular synthetic mica. This allows the insulation unit and/or the further insulation unit to be made in particular at least largely of a material with an optimized price/performance ratio, in particular allowing a high level of economic efficiency to be achieved.

Insulation between the first structural unit and the second structural unit can in particular be perfected in a household appliance, in particular in a household cooking appliance, with at least one inventive household appliance device.

A high degree of safety and/or a high level of viability can be achieved in particular by a method for operating an inventive household appliance device, which has at least one insulation unit, which is provided for insulation between at least one first structural unit and at least one second structural unit, an exterior shape of the insulation unit being tailored to the first structural unit for the purpose of placing the insulation unit and thermal expansion of at least one subregion of the insulation unit being at least substantially compensated for.

The household appliance device here is not restricted to the application and embodiment described above. In particular the household appliance device can have a number of individual elements, parts and units that is different from the number cited herein to comply with a mode of operation described herein.

Further advantages will emerge from the description of the drawing that follows. The drawing shows exemplary embodiments of the invention. The drawing, description and claims contain numerous features in combination. The person skilled in the art will expediently also consider the features individually and bring them together to form meaningful further combinations.

DETAILED DESCRIPTION OF EXEMPLARY EMBODIMENTS OF THE PRESENT INVENTION

Figure 1:
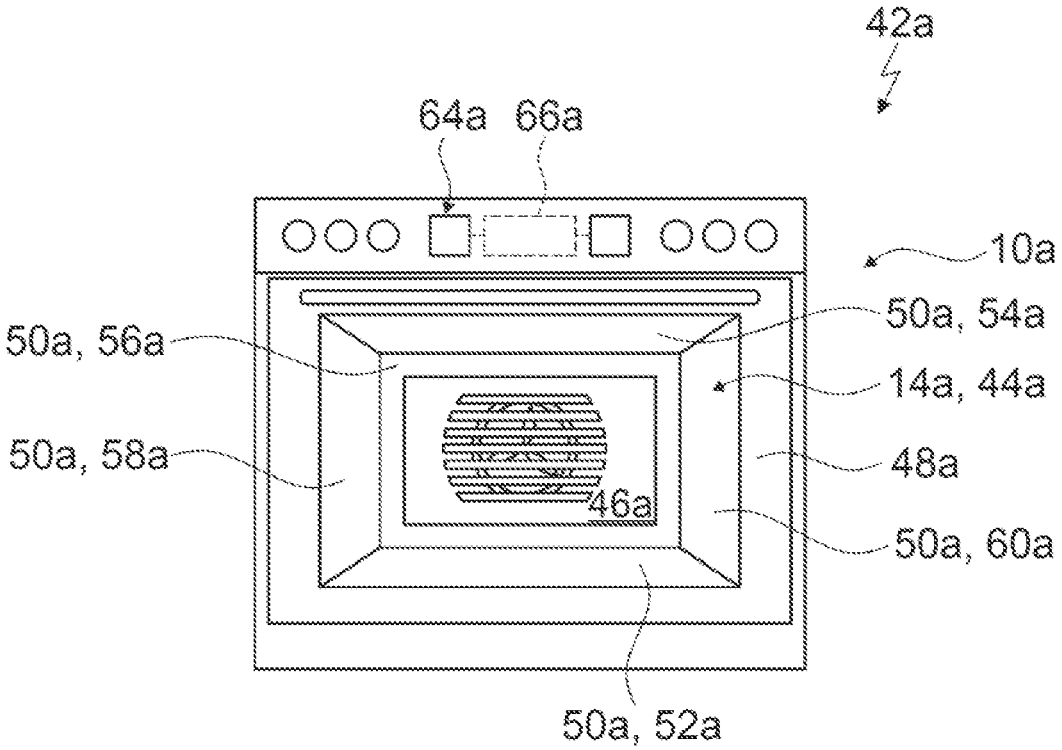
FIG. 1 shows a schematic diagram of a household appliance with a household appliance device.

FIG. 1 shows a household appliance 42*a*, which is configured as a household cooking appliance. As an alternative to being configured as a household cooking appliance the household appliance 42*a* could be configured as a cleaning appliance for example. For example the household appliance 42*a* configured as a household cooking appliance could be configured as a cooktop, preferably an induction cooktop, and/or a microwave and/or a grill appliance and/or a steam cooking appliance. In the present exemplary embodiment the household appliance 42*a* is configured as an oven and preferably as an induction oven.

The household appliance 42*a* has a household appliance device 10*a*. The household appliance device 10*a* is configured as a household cooking appliance device. In the present exemplary embodiment the household appliance device 10*a* is configured as an oven device and preferably as an induction oven device.

The household appliance device 10*a* has a muffle 44*a*. The muffle 44*a* partially delimits a cooking space 46*a*. The muffle 44*a* substantially delimits the cooking space 46*a* together with a cooking appliance door 48*a*. The household appliance device 10*a* has the cooking appliance door 48*a*.

In the present exemplary embodiment the household appliance device 10*a* has five muffle walls 50*a*. Where an object is present multiple times in the figures, only one is shown with a reference character. The muffle walls 50*a* are part of the muffle 44*a*. The muffle walls 50*a* together with the cooking appliance door 48*a* substantially define the cooking space 46*a*.

One of the muffle walls 50*a* is configured as a muffle bottom wall 52*a*. One of the muffle walls 50*a* is configured as a muffle top wall 54*a*. One of the muffle walls 50*a* is configured as a muffle rear wall 56*a*. Two of the muffle walls 50*a* are configured as muffle side walls 58*a*, 60*a*. Only one of the muffle walls 50*a* is described in the following.

The household appliance device 10*a* has an operator interface 64*a* for inputting and/or selecting operating parameters (see FIG. 1), for example a heating power and/or a heating power density and/or a heating zone. The operator interface 64*a* is provided to output a value of an operating parameter to an operator.

Figure 2:
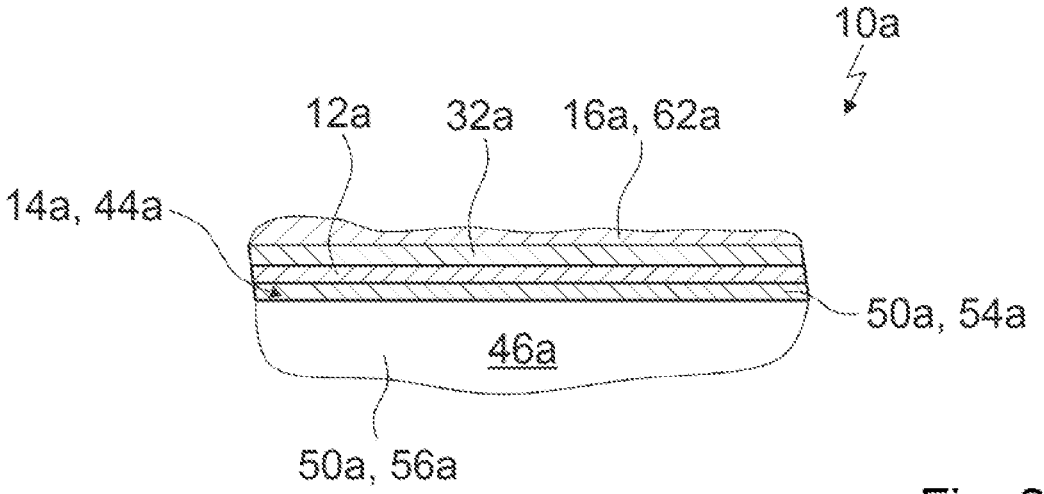
FIG. 2 shows a schematic sectional diagram of a detail of the household appliance.

The household appliance device 10*a* has a control unit 66*a*. The control unit 66*a* is provided to perform actions and/or change settings as a function of operating parameters input by way of the operator interface 64*a*. In an operating state the control unit 66*a* regulates an energy supply to at least one heating unit 62*a* (see FIGS. 2 and 6).

In the present exemplary embodiment the household appliance device 10*a* has two heating units 62*a*. Only one of the heating units 62*a* is shown in the figures. Alternatively the household appliance device 10*a* could in particular have a different number of heating units 62*a*. For example the household appliance device 10*a* could have just one single heating unit 62*a*. Alternatively the household appliance device 10*a* could have for example at least three, in particular at least four, advantageously at least five and preferably multiple heating units 62*a*.

In an operating state the heating units 62*a* are arranged outside the cooking space 46*a*. A lower heating unit 62*a* of the heating units 62*a* is arranged below the muffle wall 50*a* configured as a muffle bottom wall 52*a* in an installed position. The lower heating unit 62*a* is arranged on the muffle wall 50*a* configured as a muffle bottom wall 52*a*.

An upper heating unit 62*a* of the heating units 62*a* is arranged above the muffle wall 50*a* configured as a muffle top wall 54*a* in an installed position. The upper heating unit 62*a* is arranged on the muffle wall 50*a* configured as a muffle top wall 54*a*.

Alternatively at least one heating unit 62*a* could be arranged on a muffle wall 50*a* configured as a muffle side wall 58*a*, 60*a* and/or on a muffle wall 50*a* configured as a muffle rear wall 56*a*. Only one of the heating units 62*a* is described in the following.

For example the heating unit 62*a* could be configured as a resistance heating unit. In the present exemplary embodiment the heating unit 62*a* is configured as an induction heating unit.

The household appliance device 10*a* has one insulation unit 12*a* per heating unit 62*a* (see FIGS. 2, 3, 5 and 6). The insulation unit 12*a* is provided for insulation between a first structural unit 14*a* and a second structural unit 16*a*. In an operating state the insulation unit 12*a* insulates the first structural unit 14*a* and the second structural unit 16*a* from one another.

The household appliance device 10*a* has the first structural unit 14*a*. In the present exemplary embodiment the first structural unit 14*a* is the muffle 44*a*.

The household appliance device 10*a* has the second structural unit 16*a*. In the present exemplary embodiment the second structural unit 16*a* is the heating unit 62*a*.

The insulation unit 12*a* is provided for electrical insulation between the first structural unit 14*a* and the second structural unit 16*a*. In an operating state the insulation unit 12*a* insulates the first structural unit 14*a* and the second structural unit 16*a* electrically from one another.

In particular the insulation unit 12*a* is provided for thermal insulation between the first structural unit 14*a* and the second structural unit 16*a* in addition to the electrical insulation between the first structural unit 14*a* and the second structural unit 16*a*. In an operating state the insulation unit 12*a* insulates the first structural unit 14*a* and the second structural unit 16*a* thermally from one another.

In an operating state the insulation unit 12*a* is largely arranged between the first structural unit 14*a* and the second structural unit 16*a*. In an operating state the insulation unit 12*a* is arranged on the muffle wall 50*a* of the muffle 44*a*.

Figure 3:
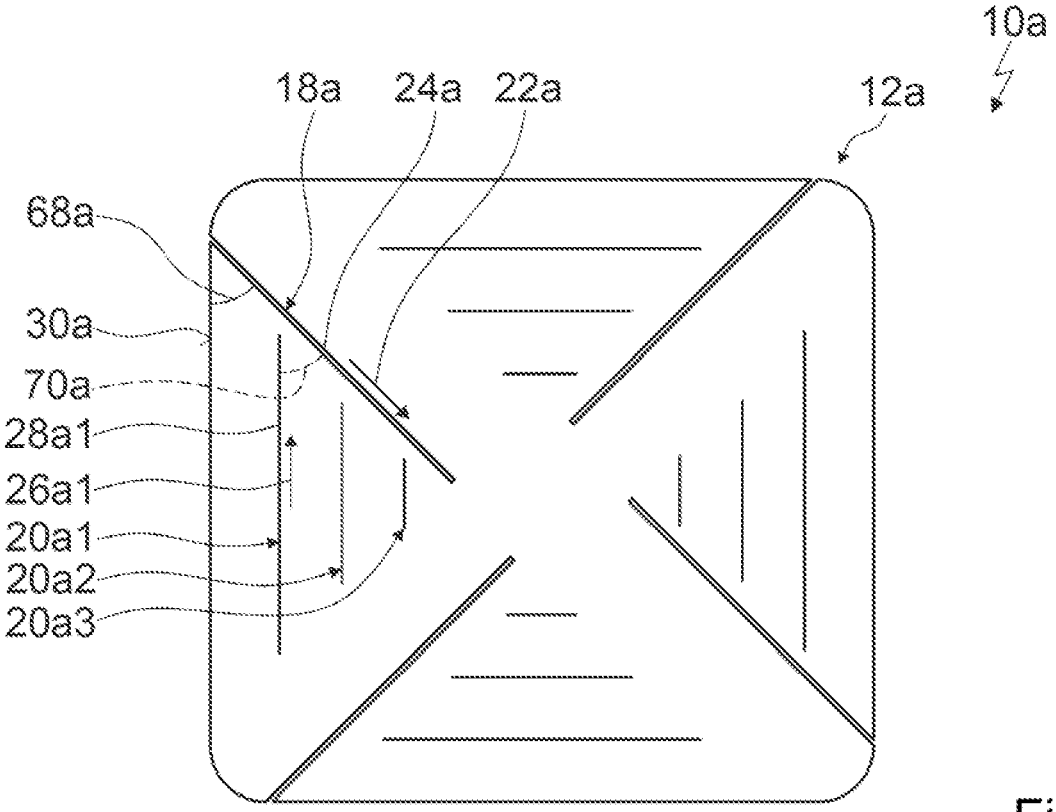
FIG. 3 shows a schematic top view of an insulation unit of the household appliance device in an unmounted state.
Figure 5:
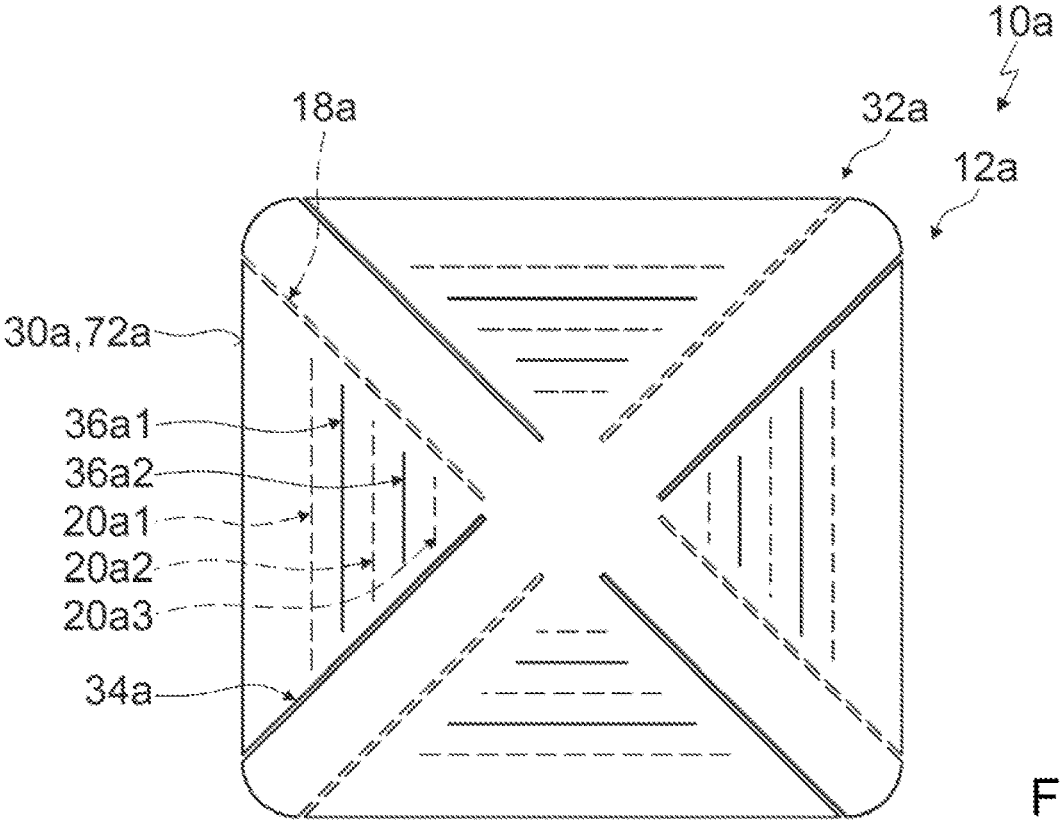
FIG. 5 shows a schematic top view of the insulation unit and the further insulation unit, which are arranged in an overlapping arrangement, in an unmounted state.
Figure 6:
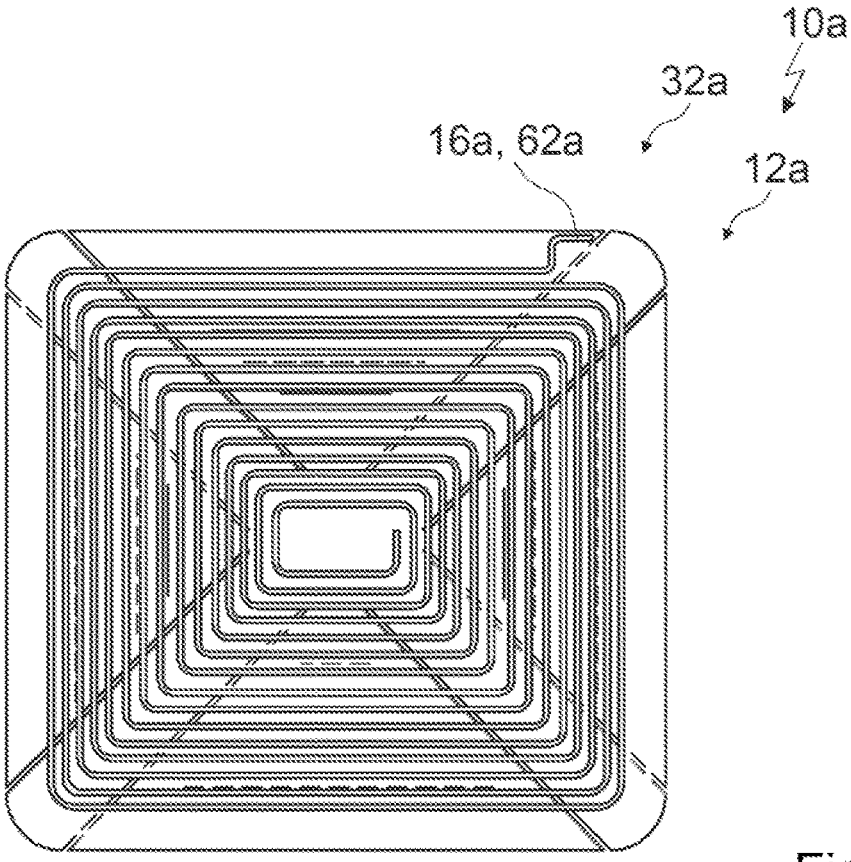
FIG. 6 shows a schematic top view of the insulation unit and the further insulation unit, which are arranged in an overlapping arrangement, and a heating unit of the household appliance device in an unmounted state.

In the present exemplary embodiment the insulation unit 12*a* has four placement assist elements 18*a* (see FIGS. 3, 5 and 6). Alternatively the insulation unit 12*a* could in particular have a different number of placement assist elements 18*a*. For example the insulation unit 12*a* could have just one single placement assist element 18*a*. Alternatively or additionally the insulation unit 12*a* could have for example at least two and in particular at least four placement assist elements 18*a*. Alternatively the insulation unit 12*a* could have for example at least five, in particular at least six, advantageously at least eight and preferably multiple placement assist elements 18*a*. Only one of the placement assist elements 18*a* is described in the following.

The placement assist element 18*a* is provided to tailor an exterior shape of the insulation unit 12*a* to the first structural unit 14*a* for the purpose of placing the insulation unit 12*a*. In an operating state the placement assist element 18*a* is provided for the purpose of placing the insulation unit 12*a* in a region of at least one edge and/or unevenness of the first structural unit 14*a*.

In an unmounted state the placement assist element 18*a* has a notch in the insulation unit 12*a*. In an unmounted state the placement assist element 18*a* is formed by a notch in the insulation unit 12*a*. In the present exemplary embodiment the placement assist element 18*a* is configured in a straight line. The placement assist element 18*a* has just one single segment 24*a*.

In an unmounted state the placement assist element 18*a* adjoins a lateral boundary 30*a* of the insulation unit 12*a*. In an unmounted state the placement assist element 18*a* extends from the lateral boundary 30*a* of the insulation unit 12*a* in the direction of a center point and/or center of gravity of the insulation unit 12*a*. In the present exemplary embodiment the placement assist element 18*a* is at a minimum angle 68*a* of substantially 45° to the lateral boundary 30*a* of the insulation unit 12*a* in an unmounted state.

In the present exemplary embodiment the insulation unit 12*a* has twelve expansion compensation elements 20. The expansion compensation elements 20*a* are grouped in four groups. Each group of expansion compensation elements 20*a* is defined by three expansion compensation elements 20*a*. The expansion compensation elements 20*a* of each group differ in respect of a longitudinal extension of the respective expansion compensation elements 20*a*.

An expansion compensation element 20*a*1 closest to a lateral boundary 30*a* of the insulation unit 12*a* has a greater longitudinal extension than an expansion compensation element 20*a*3 closest to a center point and/or center of gravity of the insulation unit 12*a*. The expansion compensation elements 20*a* of a respective group are grouped with decreasing longitudinal extension from the lateral boundary 30*a* of the insulation unit 12*a* in the direction of a center point and/or center of gravity of the insulation unit 12*a*. A central expansion compensation element 20*a*2 has a longitudinal extension that is smaller than a longitudinal extension of an expansion compensation element 20*a*1 closest to the lateral boundary 30*a* of the insulation unit 12*a* and greater than a longitudinal extension of an expansion compensation element 20*a*3 closest to the center point and/or center of gravity of the insulation unit 12*a*.

The expansion compensation elements 20*a* of each group are aligned substantially parallel to one another. Only one of the expansion compensation elements 20*a* is described in the following.

The expansion compensation element 20*a* is provided to compensate substantially for thermal expansion of at least one subregion of the insulation unit 12*a*. In an operating state the expansion compensation element 20*a* allows thermal expansion of the subregion of the insulation unit 12*a*. In an operating state the expansion compensation element 20*a* compensates substantially for thermal expansion of at least one subregion of the insulation unit 12*a*.

In the present exemplary embodiment the expansion compensation element 20*a* is configured in a straight line. The expansion compensation element 20*a* has just one single segment 28*a*. In an unmounted state the expansion compensation element 20*a* is aligned substantially parallel to a lateral boundary 30*a* of the insulation unit 12*a*.

In an unmounted state a longitudinal extension direction 22*a* of the segment 24*a* of the placement assist element 18*a* is aligned at an angle to a longitudinal extension direction 26*a* of the segment 28*a* of the expansion compensation element 20*a*. In the present exemplary embodiment a longitudinal extension direction 22*a* of the segment 24*a* of the placement assist element 18*a* and a longitudinal extension direction 26*a* of the segment 28*a* of the expansion compensation element 20*a* are at a minimum angle 70*a* of substantially 45° in an unmounted state.

In an unmounted state the expansion compensation element 20*a* has at least one material weakening of the insulation unit 12*a*. For example in an unmounted state the expansion compensation element 20*a* could have a smaller thickness of the insulation unit 12*a* and/or a recess in the insulation unit 12*a*. In the present exemplary embodiment in an unmounted state the expansion compensation element 20 has a notch in the insulation unit 12*a*.

In an unmounted state the expansion compensation element 20*a* is arranged completely within a surface extension of the insulation unit 12*a* in the main extension plane when a main extension plane of the insulation unit 12*a* is viewed in a perpendicular manner. In an unmounted state the expansion compensation element 20*a* is arranged at a distance from lateral boundaries 30*a* of the insulation unit 12*a* when a main extension plane of the insulation unit 12*a* is viewed in a perpendicular manner.

Figure 4:
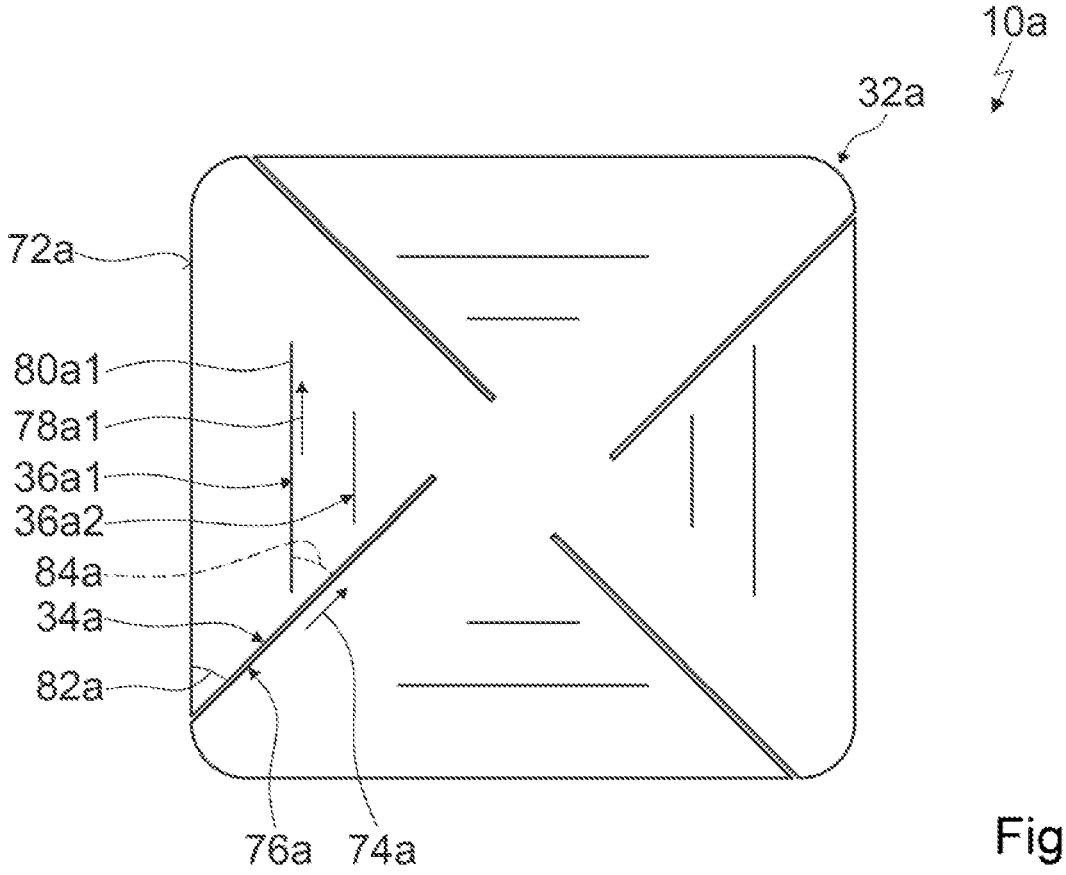
FIG. 4 shows a schematic top view of a further insulation unit of the household appliance device in an unmounted state.

In addition to the insulation unit 12*a* the household appliance device 10*a* has a further insulation unit 32*a* (see FIGS. 4 to 6). The further insulation unit 32*a* differs from the insulation unit 12*a* in at least one feature. The further insulation unit 32*a* differs from the insulation unit 12*a* in an arrangement of placement assist elements 18*a*, 34*a* relative to a lateral boundary 30*a*, 72*a*. In the present exemplary embodiment the further insulation unit 32*a* differs from the insulation unit 12*a* in a number of expansion compensation elements 20*a*, 36*a* and/or in an arrangement of expansion compensation elements 20*a*, 36*a* relative to a lateral boundary 30*a*, 72*a*.

In the present exemplary embodiment the further insulation unit 32*a* has four further placement assist elements 34*a*. Only one of the further placement assist elements 34*a* is described in the following.

The further placement assist element 34*a* is provided to tailor an exterior shape of the further insulation unit 32*a* to the first structural unit 14*a* for the purpose of placing the further insulation unit 32*a*. In an operating state the further placement assist element 34*a* is provided for the purpose of placing the further insulation unit 32*a* in a region of at least one edge and/or unevenness of the first structural unit 14*a*.

In an unmounted state the further placement assist element 34*a* has a notch in the further insulation unit 32*a*. In an unmounted state the further placement assist element 34*a* is formed by a notch in the further insulation unit 32*a*. In the present exemplary embodiment the further placement assist element 34*a* is configured in a straight line. The further placement assist element 34*a* has just one single segment 76*a*.

In an unmounted state the further placement assist element 34*a* adjoins a lateral boundary 72*a* of the further insulation unit 32*a*. In an unmounted state the further placement assist element 34*a* extends from the lateral boundary 72*a* of the further insulation unit 32*a* in the direction of a center point and/or center of gravity of the further insulation unit 32*a*. In the present exemplary embodiment in an unmounted state the further placement assist element 34*a* is at a minimum angle 82*a* of substantially 45° to the lateral boundary 72*a* of the further insulation unit 32*a*.

In the present exemplary embodiment the further insulation unit 32*a* has eight further expansion compensation elements 36*a*. The further expansion compensation elements 36*a* are grouped in four groups. Each group of further expansion compensation elements 36*a* is defined by two further expansion compensation elements 36*a*. The further expansion compensation elements 36*a* of each group differ in respect of a longitudinal extension of the respective further expansion compensation elements 36*a*.

A further expansion compensation element 36*a*1 closest to a lateral boundary 72*a* of the further insulation unit 32*a* has a greater longitudinal extension than a further expansion compensation element 36*a*2 closest to a center point and/or center of gravity of the further insulation unit 32*a*. The further expansion compensation elements 36*a* of a respective group are grouped with decreasing longitudinal extension from the lateral boundary 72*a* of the further insulation unit 32*a* in the direction of a center point and/or center of gravity of the further insulation unit 32*a*.

The further expansion compensation elements 36*a* of each group are aligned substantially parallel to one another. Only one of the further expansion compensation elements 36*a* is described in the following.

The further expansion compensation element 36*a* is provided to compensate substantially for thermal expansion of at least one subregion of the further insulation unit 32*a*. In an operating state the further expansion compensation element 36*a* allows thermal expansion of the subregion of the further insulation unit 32*a*. In an operating state the further expansion compensation element 36*a* compensates substantially for thermal expansion of at least one subregion of the further insulation unit 32*a*.

In the present exemplary embodiment the further expansion compensation element 36*a* is configured in a straight line. The further expansion compensation element 36*a* has just one single segment 80*a*. In an unmounted state the further expansion compensation element 36*a* is aligned substantially parallel to a lateral boundary 72*a* of the further insulation unit 32*a*.

In an unmounted state a longitudinal extension direction 74*a* of the segment 76*a* of the further placement assist element 34*a* is aligned at an angle to a longitudinal extension direction 78*a* of the segment 80*a* of the further expansion compensation element 36*a*. In the present exemplary embodiment a longitudinal extension direction 74*a* of the segment 76*a* of the further placement assist element 34*a* and a longitudinal extension direction 78*a* of the segment 80*a* of the further expansion compensation element 36*a* are at a minimum angle 84*a* of substantially 45° in an unmounted state.

In an unmounted state the further expansion compensation element 36*a* has at least one material weakening of the further insulation unit 32*a*. For example in an unmounted state the further expansion compensation element 36*a* could have a smaller thickness of the further insulation unit 32*a* and/or a recess in the further insulation unit 32*a*. In the present exemplary embodiment in an unmounted state the further expansion compensation element 36 has a notch in the further insulation unit 32*a*.

In an unmounted state the further expansion compensation element 36*a* is arranged completely within a surface extension of the further insulation unit 32*a* in the main extension plane when a main extension plane of the further insulation unit 32*a* is viewed in a perpendicular manner. In an unmounted state the further expansion compensation element 36*a* is arranged at a distance from lateral boundaries 72*a* of the further insulation unit 32*a* when a main extension plane of the further insulation unit 32*a* is viewed in a perpendicular manner.

In an unmounted state the insulation unit 12*a* and the further insulation unit 32*a* have substantially and advantageously completely the same surface extension (see FIGS. 3 to 6). In an unmounted state the insulation unit 12*a* and the further insulation unit 32*a* have substantially and advantageously completely the same exterior form.

When a main extension plane of the insulation unit 12*a* is viewed in a perpendicular manner and when there is an overlapping arrangement of the insulation unit 12*a* and the further insulation unit 32*a*, the placement assist element 18*a* and the further placement assist element 34*a* are arranged without overlap in an unmounted state. When there is an overlapping arrangement of the insulation unit 12*a* and the further insulation unit 32*a*, lateral boundaries 30*a* of the insulation unit 12*a*, in particular all the lateral boundaries 30*a* of the insulation unit 12*a*, and lateral boundaries 72*a* of the further insulation unit 32*a*, in particular all the lateral boundaries 72*a* of the further insulation unit 32*a*, lie on top of one another.

When a main extension plane of the insulation unit 12*a* is viewed in a perpendicular manner and when there is an overlapping arrangement of the insulation unit 12*a* and the further insulation unit 32*a*, the expansion compensation element 20*a* and the further expansion compensation element 36*a* are arranged without overlap in an unmounted state. When there is an overlapping arrangement of the insulation unit 12*a* and the further insulation unit 32*a*, expansion compensation elements 20*a* and further expansion compensation elements 36*a* are arranged in an alternating manner in an unmounted state.

In an unmounted state and with an overlapping arrangement of the insulation unit 12*a* and the further insulation unit 32*a* a further expansion compensation element 36*a* is arranged between every two expansion compensation elements 20*a*. In an unmounted state and with an overlapping arrangement of the insulation unit 12*a* and the further insulation unit 32*a* an expansion compensation element 20*a* is arranged between every two further expansion compensation elements 36*a*.

When there is an overlapping arrangement of the insulation unit 12*a* and the further insulation unit 32*a*, the placement assist element 18*a* and the further placement assist element 34*a* define a substantially right-angled triangle in an unmounted state. In an unmounted state every expansion compensation element 20*a* and every further expansion compensation element 36*a* are arranged between the placement assist element 18*a* and the further placement assist element 34*a*.

In the present exemplary embodiment the insulation unit 12*a* is configured as a single piece. The insulation unit 12*a* is formed from a single piece. In the present exemplary embodiment the insulation unit 12*a* is largely made of mica, in particular synthetic mica.

FIGS. 7 to 15 show two further exemplary embodiments of the invention. The descriptions which follow are limited substantially to the differences between the exemplary embodiments, it being possible to refer to the description of the exemplary embodiment in FIGS. 1 to 6 for parts, features and functions that remain the same. To differentiate between the exemplary embodiments, the letter a in the reference characters of the exemplary embodiment in FIGS. 1 to 6 is replaced by the letters b and c in the reference characters of the exemplary embodiment in FIGS. 7 to 15. In principle reference can be made to the drawings and/or description of the exemplary embodiment in FIGS. 1 to 6 for parts designated in the same manner, in particular for parts with the same reference characters.

Figure 7:
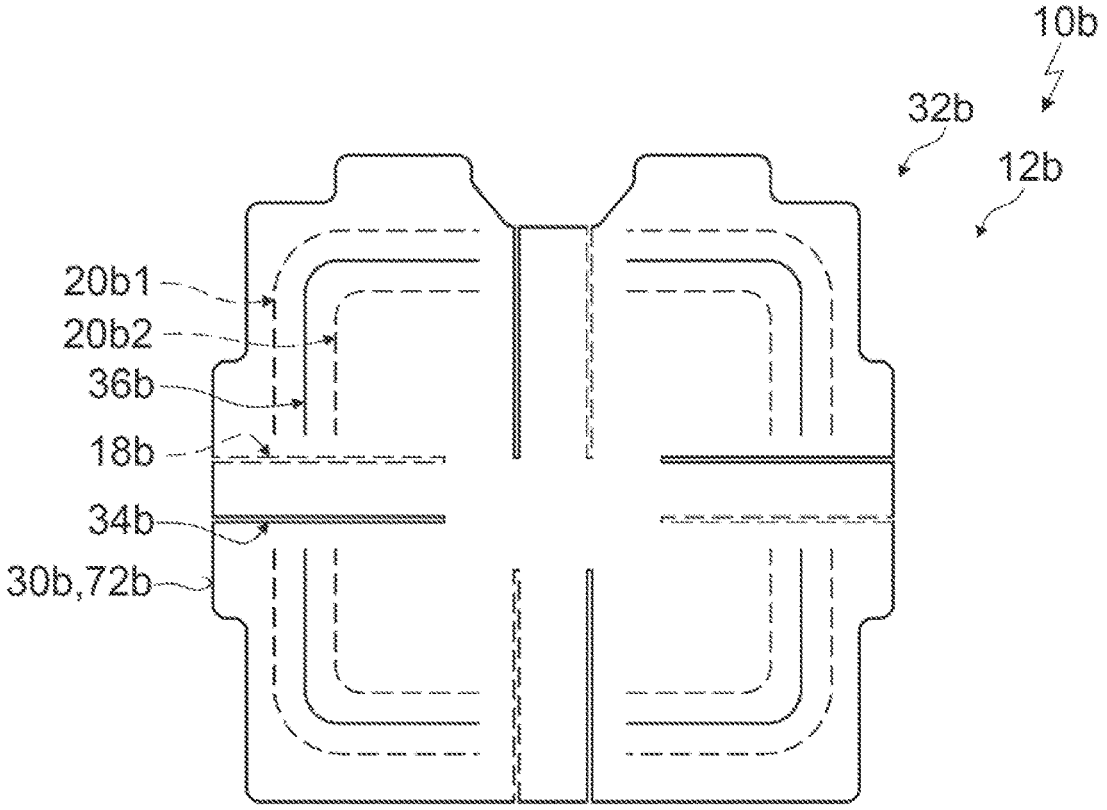
FIG. 7 shows a schematic top view of an insulation unit and a further insulation unit, which are arranged in an overlapping arrangement, in an unmounted state.

FIG. 7 shows an insulation unit 12*b* and a further insulation unit 32*b*, which are arranged in an overlapping arrangement, and a heating unit 62*b* of an alternative household appliance device 10*b* in an unmounted state. The further insulation unit 32*b* differs from the insulation unit 12*b* in at least one feature. The further insulation unit 32*b* differs from the insulation unit 12*b* in an arrangement of placement assist elements 18*b*, 34*b* relative to a lateral boundary 30*b*, 72*b*. In the present exemplary embodiment the further insulation unit 32*b* differs from the insulation unit 12*b* in a number of expansion compensation elements 20*b*, 36*b* and/or in an arrangement of expansion compensation elements 20*b*, 36*b* relative to a lateral boundary 30*b*, 72*b*.

Figure 8:
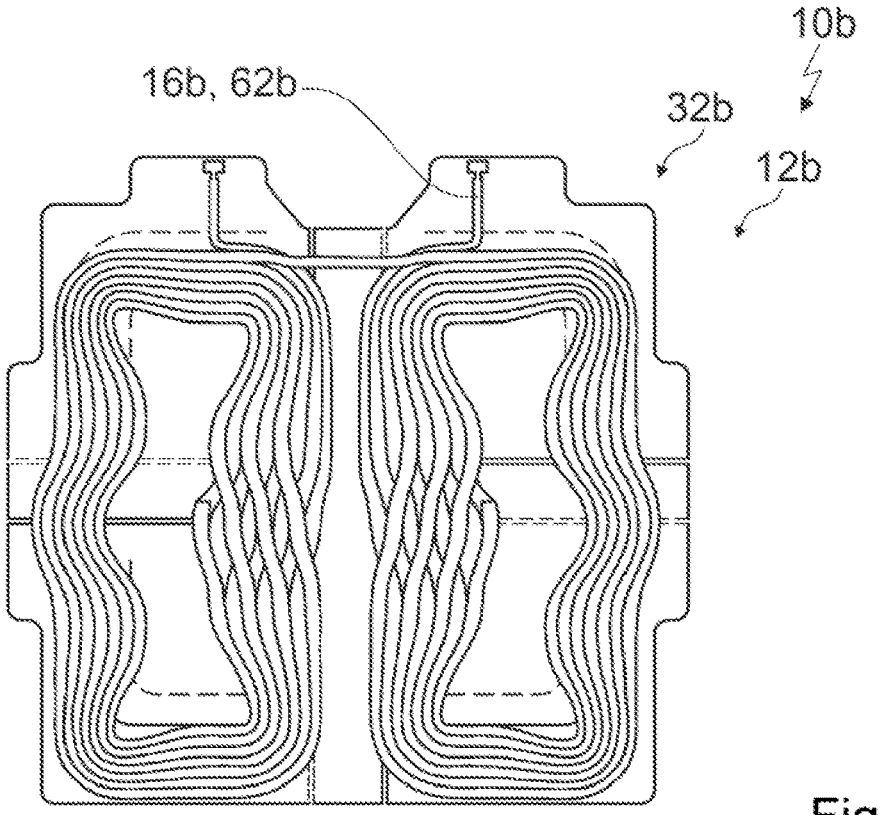
FIG. 8 shows a schematic top view of the insulation unit and the further insulation unit of FIG. 7, which are arranged in an overlapping arrangement, and a heating unit of an alternative household appliance device in an unmounted state.
Figure 9:
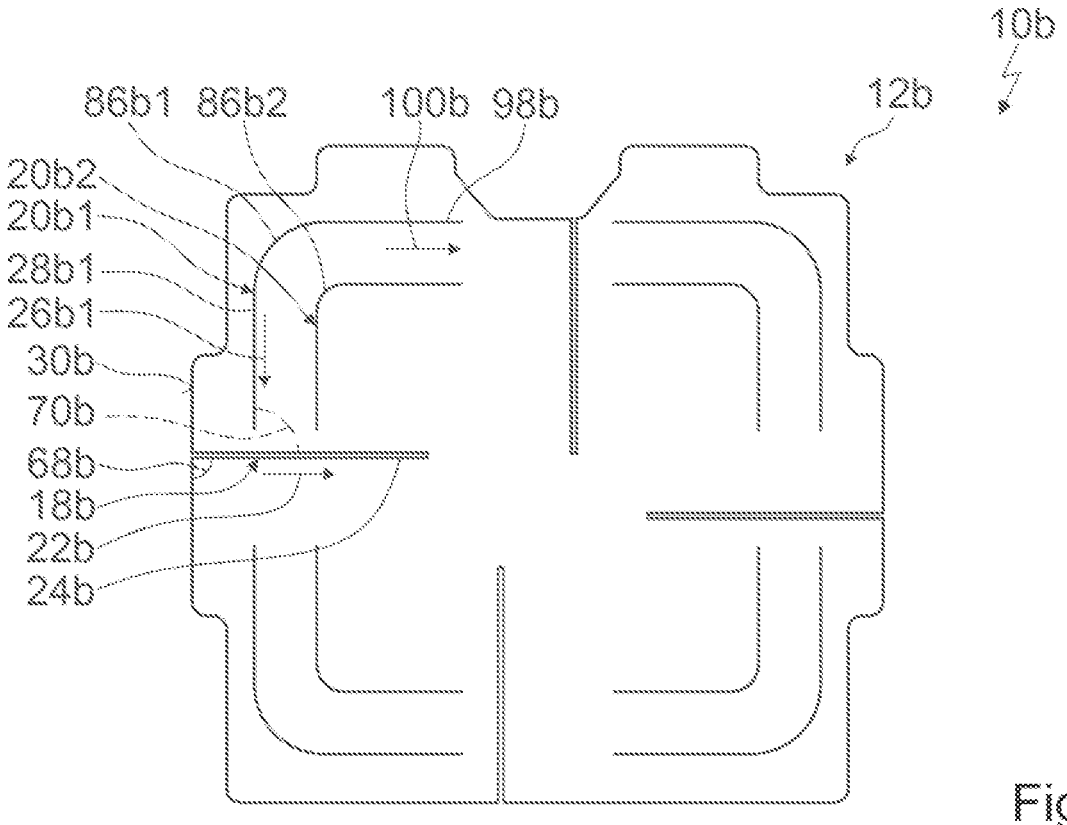
FIG. 9 shows a schematic top view of the insulation unit from FIG. 7 in an unmounted state.
Figure 10:
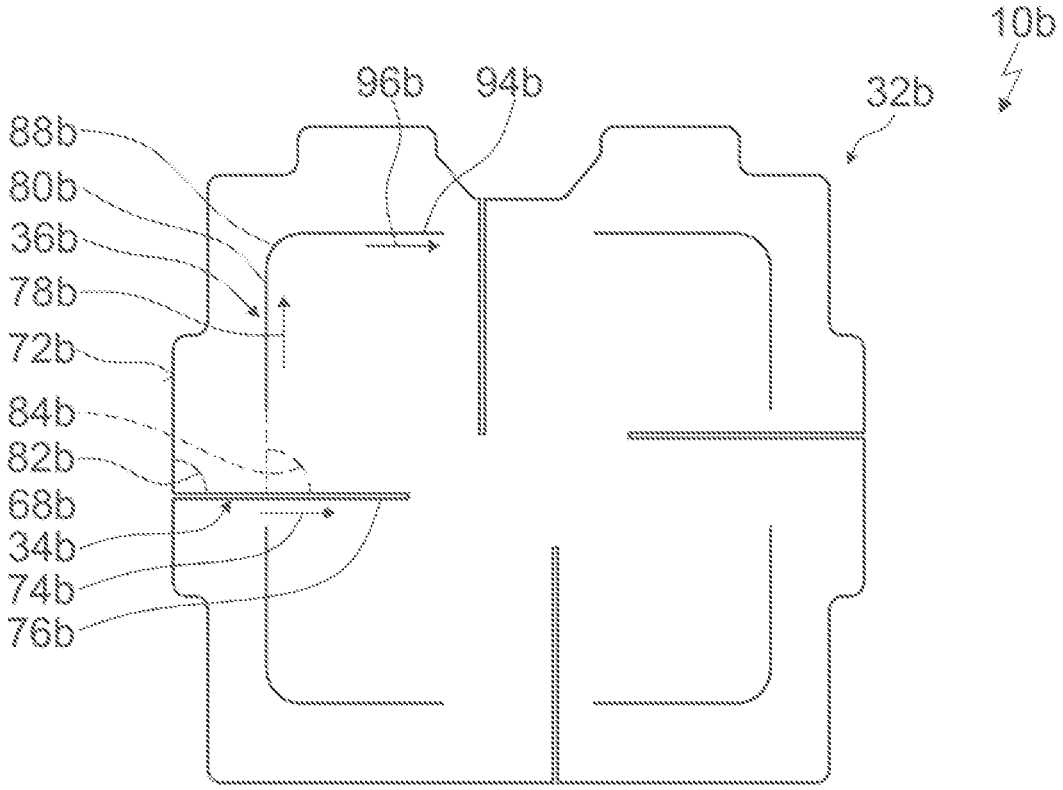
FIG. 10 shows a schematic top view of the further insulation unit from FIG. 7 in an unmounted state.

In the present exemplary embodiment the insulation unit 12*b* has four placement assist elements 18*b* (see FIGS. 7 and 8). Only one of the placement assist elements 18*b* is described in the following.

In the present exemplary embodiment the placement assist element 18*b* is configured in a straight line. The placement assist element 18*b* has just one single segment 24*b*.

In an unmounted state the placement assist element 18*b* adjoins a lateral boundary 30*b* of the insulation unit 12*b*. In the present exemplary embodiment the placement assist element 18*b* is at a minimum angle 68*b* of substantially 90° to the lateral boundary 30*b* of the insulation unit 12*b* in an unmounted state.

In the present exemplary embodiment the insulation unit 12*b* has eight expansion compensation elements 20*b*. The expansion compensation elements 20*b* are grouped in four groups. Each group of expansion compensation elements 20*b* is defined by two expansion compensation elements 20*b*. The expansion compensation elements 20*b* of each group differ in respect of a longitudinal extension of the respective expansion compensation elements 20*b*.

An expansion compensation element 20*b*1 closest to a lateral boundary 30*b* of the insulation unit 12*b* has a greater longitudinal extension than an expansion compensation element 20*b*2 closest to a center point and/or center of gravity of the insulation unit 12*b*.

The expansion compensation elements 20*b* of each group are aligned substantially parallel to one another. Only one of the expansion compensation elements 20*b* is described in the following.

In the present exemplary embodiment the expansion compensation element 20*b* has two segments 28*b*, 98*b*. A first segment 28*b* of the segments 28*b*, 98*b* of the expansion compensation element 20*b* has a longitudinal extension direction 26*b*, which is aligned perpendicular to a longitudinal extension direction 100*b* of a second segment 98*b* of the segments 28*b*, 98*b* of the expansion compensation element 20*b*.

The expansion compensation element 20*b* has a transition segment 86*b*, which connects the segments 28*b*, 98*b* of the expansion compensation element 20*b* to one another. The transition segment is configured in the shape of a circular arc, in particular a quarter circular arc. Only one of the segments 28*b*, 98*b* of the expansion compensation element 20*b* is described in the following.

In an unmounted state the segment 28*b* of the expansion compensation element 20*a* is aligned substantially parallel to a lateral boundary 30*b* of the insulation unit 12*b*. The segment 28*b* of the expansion compensation element 20*b* is configured in a straight line.

A longitudinal extension direction 26*b* of the segment 28*b* of the expansion compensation element 20*b*, in particular of each of the segments 28*b* of the expansion compensation element 20*b*, is aligned at an angle to a longitudinal extension direction 22*b* of the segment 24*b* of the placement assist element 18*b* in an unmounted state. In the present exemplary embodiment a longitudinal extension direction 26*b* of the segment 28*b* of the expansion compensation element 20*b*, in particular of each of the segments 28*b* of the expansion compensation element 20*b*, and a longitudinal extension direction 22*b* of the segment 24*b* of the placement assist element 18*b* are at minimum angle 70*b* of substantially 90° in an unmounted state.

In the present exemplary embodiment the further insulation unit 32*b* has four further placement assist elements 34*b*. In the present exemplary embodiment the further insulation unit 32*b* has four further expansion compensation elements 36*b*. Only one of the further placement assist elements 34*b* and only one of the further expansion compensation elements 36*b* are described in the following.

In an unmounted state the further placement assist element 34*b* adjoins a lateral boundary 72*b* of the further insulation unit 32*b*. In the present exemplary embodiment in an unmounted state the further placement assist element 24*b* is at a minimum angle 82*b* of substantially 90° to the lateral boundary 72*b* of the further insulation unit 34*b*.

In an unmounted state the further placement assist element 34*b* has substantially the same shape and/or alignment and/or form as the placement assist element 18*b*, for which reason reference should be made in particular to the description relating to the placement assist element 18*b*.

In the present exemplary embodiment the further expansion compensation element 36*b* has two segments 80*b*, 94*b*. A first segment 80*b* of the segments 80*b*, 94*b* of the further expansion compensation element 36*b* has a longitudinal extension direction 78*b*, which is aligned perpendicular to a longitudinal extension direction 96*b* of a second segment 94*b* of the segments 80*b*, 94*b* of the further expansion compensation element 36*b*.

The further expansion compensation element 36*b* has a further transition segment 88*b*, which connects the segments 80*b*, 94*b* of the further expansion compensation element 36*b* to one another. The further transition segment 88*b* is configured in the shape of a circular arc, in particular a quarter circular arc. Only one of the segments 80*b*, 94*b* of the further expansion compensation element 36*b* is described in the following.

In an unmounted state the further expansion compensation element 36*b* has substantially the same shape and/or alignment and/or form as the expansion compensation element 20*b*, for which reason reference should be made in particular to the description relating to the expansion compensation element 20*b*.

In an unmounted state and with an overlapping arrangement of the insulation unit 12*b* and the further insulation unit 32*b* the further expansion compensation element 36*b* is arranged between two expansion compensation elements 20*b*. With an overlapping arrangement of the insulation unit 12*b* and the further insulation unit 32*b* the placement assist element 18*b* and the further placement assist element 34*b* are aligned substantially parallel to one another in an unmounted state.

Figure 11:
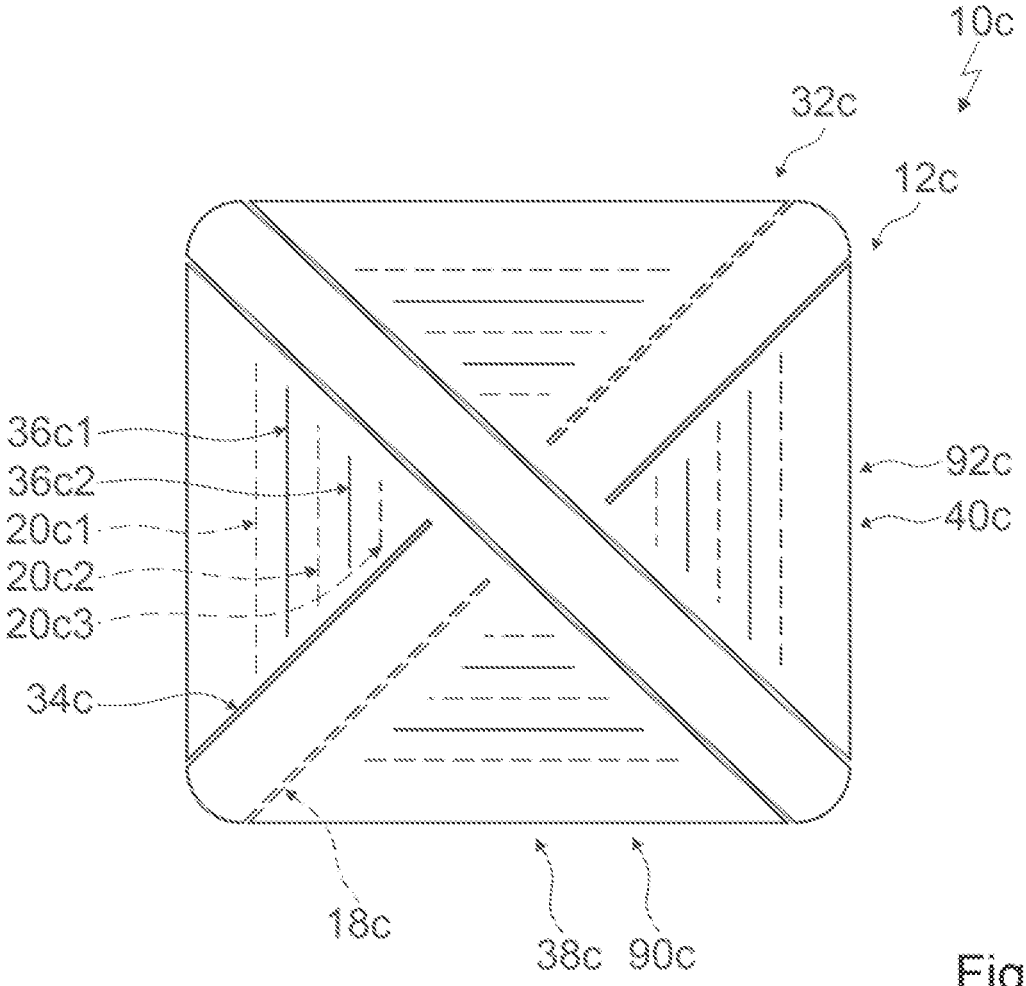
FIG. 11 shows a schematic top view of an insulation unit and a further insulation unit, which are arranged in an overlapping arrangement, of an alternative household appliance device in an unmounted state.
Figure 12:
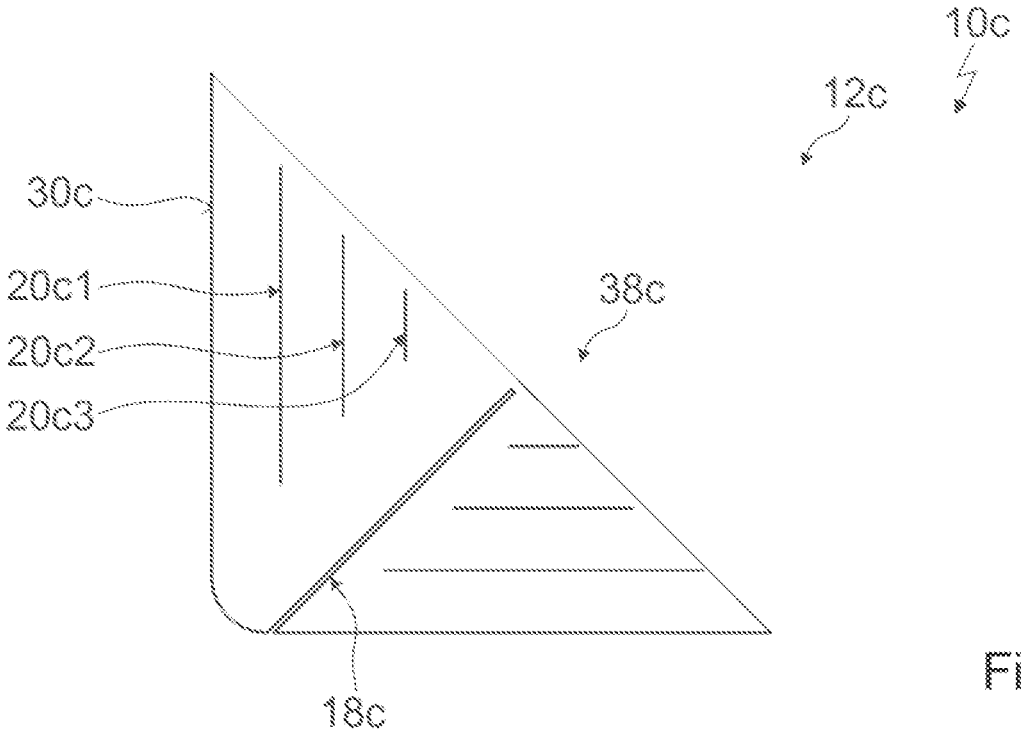
FIG. 12 shows a schematic top view of a first insulation subelement of the insulation unit from FIG. 11 in an unmounted state.
Figure 13:
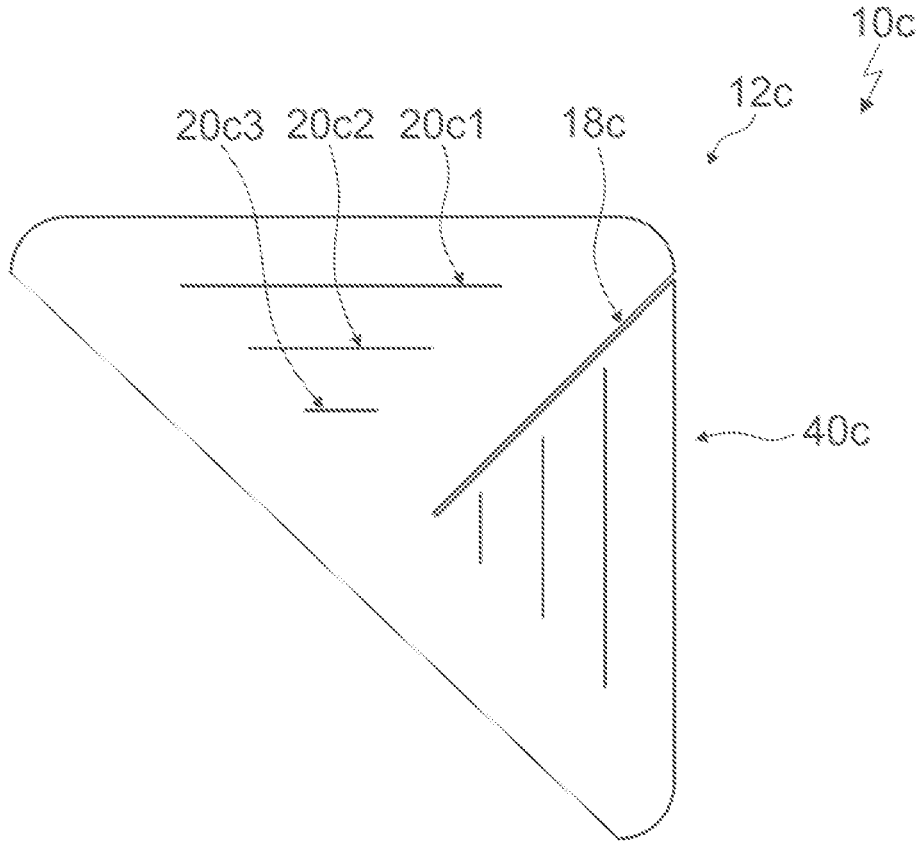
FIG. 13 shows a schematic top view of a second insulation subelement of the insulation unit from FIG. 11 in an unmounted state.
Figure 14:
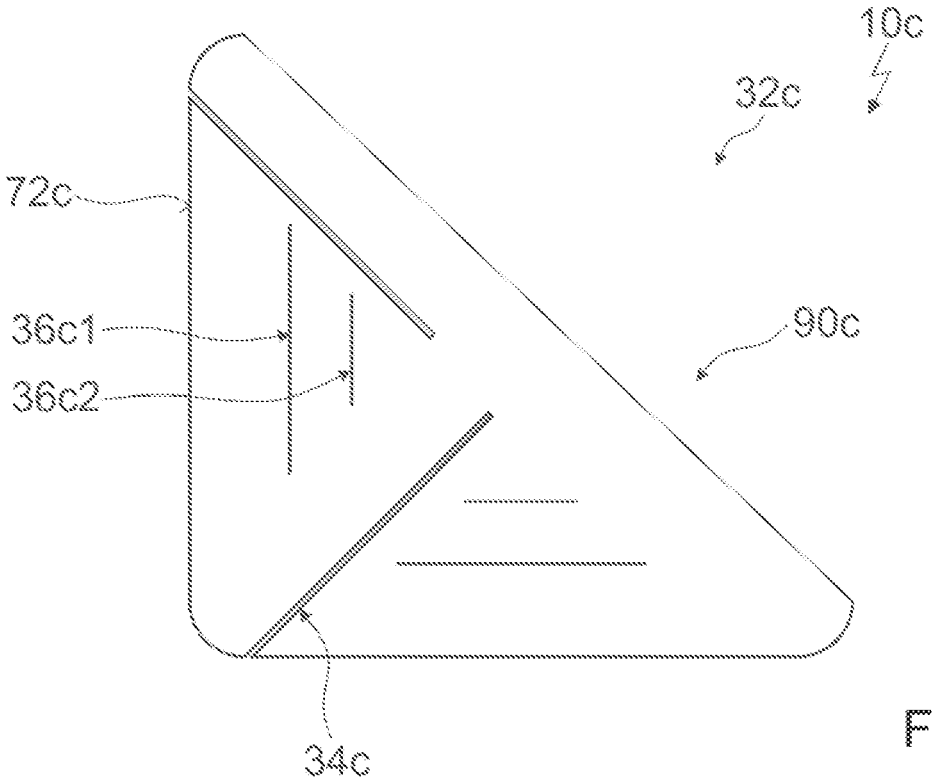
FIG. 14 shows a schematic top view of a further first insulation subelement of the further insulation unit from FIG. 11 in an unmounted state and FIG. 15 shows a schematic top view of a further second insulation subelement of the further insulation unit from FIG. 11 in an unmounted state.
Figure 15:
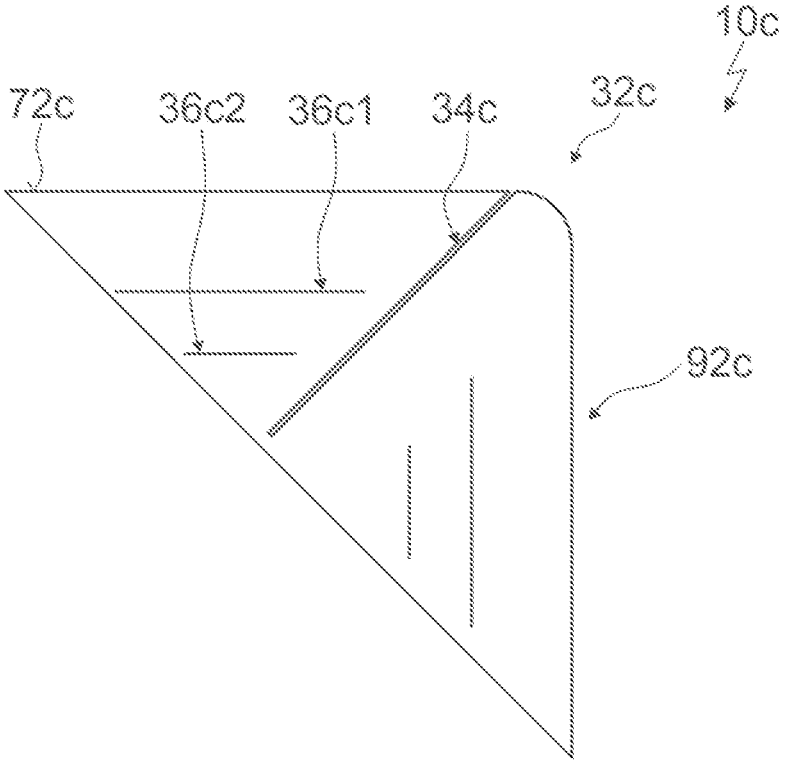

FIG. 11 shows an insulation unit 12*c* and a further insulation unit 32*c*, which are arranged in an overlapping arrangement, of an alternative household appliance device 10*c* in an unmounted state. The insulation unit 12*c* and the further insulation unit 32*c* are configured in a similar manner to the insulation unit 12*a* and the further insulation unit 32*a* from the exemplary embodiment in FIGS. 1 to 6 in respect of an arrangement of placement assist elements 18*c*, 34*c* and expansion compensation elements 20*c*, 36*c* relative to one another, for which reason reference should be made to the description relating to the exemplary embodiment in FIGS. 1 to 6 here.

In contrast to the configuration of the exemplary embodiment in FIGS. 1 to 6 the insulation unit 12*c* is configured with multiple parts. In the present exemplary embodiment the insulation unit 12*c* has a first insulation subelement 38*c* and a second insulation subelement 40*c* (see FIGS. 11 to 13). The first insulation subelement 38*c* and the second insulation subelement 40*c* are provided for mounting in a modular manner.

The first insulation subelement 38*c* and the second insulation subelement 40*c* differ from one another in at least one feature. In the present exemplary embodiment the first insulation subelement 38*c* and the second insulation subelement 40*c* differ from one another in size.

In contrast to the configuration of the exemplary embodiment in FIGS. 1 to 6 the further insulation unit 32*c* is configured with multiple parts. In the present exemplary embodiment the further insulation unit 32*c* has a further first insulation subelement 90*c* and a further second insulation subelement 92*c* (see FIGS. 11, 14 and 15). The further first insulation subelement 90*c* and the further second insulation subelement 92*c* are provided for mounting in a modular manner.

The further first insulation subelement 90*c* and the further second insulation subelement 92*c* differ from one another in at least one feature. In the present exemplary embodiment the further first insulation subelement 90*c* and the further second insulation subelement 92*c* differ from one another in size and/or in number of placement assist elements 18*c*, 34*c*.

The invention claimed is:

1. A household appliance device, comprising:

a first structural unit;

a second structural unit; and an insulation unit configured to provide an insulation between the first and second structural units, said insulation unit including a placement assist element configured to tailor an exterior shape of the insulation unit to the first structural unit for placement of the insulation unit, wherein the placement assist element comprises a notch configured to enable bending of the insulation unit; and an expansion compensation element configured to compensate at least substantially a thermal expansion of at least one subregion of the insulation unit.

2. The household appliance device of claim 1, constructed in the form of a household cooking appliance device.

3. The household appliance device of claim 1, wherein the notch includes a segment which defines a longitudinal extension direction which is aligned at an angle to a longitudinal extension direction of a segment of the expansion compensation element in an unmounted state.

4. The household appliance device of claim 1, wherein the notch adjoins a lateral boundary of the insulation unit in an unmounted state.

5. The household appliance device of claim 4, wherein the notch extends at a minimum angle of at least substantially 45° to the lateral boundary of the insulation unit in the unmounted state.

6. The household appliance device of claim 1, wherein the expansion compensation element is formed by a material weakening of the insulation unit in an unmounted state.

7. The household appliance device of claim 1, wherein the expansion compensation element is arranged in an unmounted state completely within a surface extension of the insulation unit in a main extension plane when the main extension plane of the insulation unit is viewed in a perpendicular manner.

8. The household appliance device of claim 1, further comprising a further insulation unit including a further notch and a further expansion compensation element, said further insulation unit having a configuration which differs from a configuration of the insulation unit.

9. The household appliance device of claim 8, wherein the insulation unit and the further insulation unit have at least substantially a same surface extension in an unmounted state.

10. The household appliance device of claim 8, wherein the insulation unit and the further insulation unit overlap one another such that the notch and the further notch are arranged without overlap in the unmounted state, when a main extension plane of the insulation unit is viewed in a perpendicular manner.

11. The household appliance device of claim 8, wherein the insulation unit and the further insulation unit overlap one another such that the expansion compensation element and the further expansion compensation element are arranged without overlap in the unmounted state, when a main extension plane of the insulation unit is viewed in a perpendicular manner.

12. The household appliance device of claim 1, wherein the insulation unit is configured as a single piece.

13. The household appliance device of claim 1, wherein the insulation unit has a first insulation subelement and a second insulation subelement, said first and second subelements configured to enable mounting in a modular manner.

14. The household appliance device of claim 13, wherein the first insulation subelement has a configuration which differs from a configuration of the second insulation subelement.

15. A household appliance, in particular a household cooking appliance, comprising a household appliance device, said household appliance device comprising a first structural unit, a second structural unit, and an insulation unit configured to provide an insulation between the first and second structural units, said insulation unit including a placement assist element configured to tailor an exterior shape of the insulation unit to the first structural unit for placement of the insulation unit, wherein the placement assist element comprises a notch configured to enable bending of the insulation unit and the insulation unit further comprises an expansion compensation element configured to compensate at least substantially a thermal expansion of at least one subregion of the insulation unit.

16. The household appliance of claim 15, wherein the notch includes a segment which defines a longitudinal extension direction which is aligned at an angle to a longitudinal extension direction of a segment of the expansion compensation element in an unmounted state.

17. The household appliance of claim 15, wherein the notch adjoins a lateral boundary of the insulation unit in an unmounted state.

18. The household appliance of claim 17, wherein the notch extends at a minimum angle of at least substantially 45° to the lateral boundary of the insulation unit in the unmounted state.

19. The household appliance of claim 15, wherein the expansion compensation element is formed by a material weakening of the insulation unit in an unmounted state.

20. The household appliance of claim 15, wherein the expansion compensation element is arranged in an unmounted state completely within a surface extension of the insulation unit in a main extension plane when the main extension plane of the insulation unit is viewed in a perpendicular manner.

21. The household appliance of claim 15, wherein the household appliance device comprises a further insulation unit including a further notch and a further expansion compensation element, said further insulation unit having a configuration which differs from a configuration of the insulation unit.

22. The household appliance of claim 21, wherein the insulation unit and the further insulation unit have at least substantially a same surface extension in an unmounted state.

23. The household appliance of claim 21, wherein the insulation unit and the further insulation unit overlap one another such that the notch and the further notch are arranged without overlap in the unmounted state, when a main extension plane of the insulation unit is viewed in a perpendicular manner.

24. The household appliance of claim 21, wherein the insulation unit and the further insulation unit overlap one another such that the expansion compensation element and the further expansion compensation element are arranged without overlap in the unmounted state, when a main extension plane of the insulation unit is viewed in a perpendicular manner.

25. The household appliance of claim 15, wherein the insulation unit is configured as a single piece.

26. The household appliance of claim 15, wherein the insulation unit has a first insulation subelement and a second insulation subelement, said first and second subelements configured to enable mounting in a modular manner.

27. The household appliance of claim 26, wherein the first insulation subelement has a configuration which differs from a configuration of the second insulation subelement.

28. A household appliance device, comprising:

a first structural unit;

a second structural unit;

an insulation unit configured to provide an insulation between the first and second structural units, said insulation unit including a placement assist element configured to tailor an exterior shape of the insulation unit to the first structural unit for placement of the insulation unit;

an expansion compensation element configured to compensate at least substantially a thermal expansion of at least one subregion of the insulation unit; and a further insulation unit including a further placement assist element and a further expansion compensation element, said further insulation unit having a configuration which differs from a configuration of the insulation unit;

wherein the insulation unit and the further insulation unit overlap one another such that the placement assist element and the further placement assist element are arranged without overlap in the unmounted state, when a main extension plane of the insulation unit is viewed in a perpendicular manner.

* * * * *